US009856865B2

(12) United States Patent
Simmons et al.

(10) Patent No.: US 9,856,865 B2
(45) Date of Patent: Jan. 2, 2018

(54) PNEUMATIC RECIPROCATING FLUID PUMP WITH REINFORCED SHAFT

(71) Applicant: WHITE KNIGHT FLUID HANDLING INC., Kamas, UT (US)

(72) Inventors: John M. Simmons, Kamas, UT (US); Tom M. Simmons, Kamas, UT (US); David M. Simmons, Francis, UT (US); Kenji Allen Kingsford, Oro Valley, AZ (US); Ervin Andy Hutchinson, Morgan, UT (US)

(73) Assignee: White Knight Fluid Handling Inc., Kamas, UT (US)

( * ) Notice: Subject to any disclaimer, the term of this patent is extended or adjusted under 35 U.S.C. 154(b) by 434 days.

(21) Appl. No.: 14/083,868

(22) Filed: Nov. 19, 2013

(65) Prior Publication Data

US 2014/0140869 A1 May 22, 2014

Related U.S. Application Data

(60) Provisional application No. 61/729,213, filed on Nov. 21, 2012.

(51) Int. Cl.
*F04B 9/131* (2006.01)
*F04B 39/00* (2006.01)
(Continued)

(52) U.S. Cl.
CPC ..... *F04B 9/131* (2013.01); *F04B 39/0022* (2013.01); *F04B 43/026* (2013.01); *F04B 53/14* (2013.01); *Y10T 29/49236* (2015.01)

(58) Field of Classification Search
CPC .. F04B 9/131; F04B 43/1136; F04B 39/0022; F04B 43/026; F04B 53/14; F04B 53/144;
(Continued)

(56) References Cited

U.S. PATENT DOCUMENTS 3,712,755 A * 1/1973 Otto ..... F04D 7/06 415/109
5,261,442 A * 11/1993 Kingsford ..... F16K 11/048 137/312
(Continued)

FOREIGN PATENT DOCUMENTS

JP 48064810 U 8/1973
JP 61179378 U 11/1986
(Continued)

OTHER PUBLICATIONS

"Unraveling Polymers: PTFE vs PEEK—A Comparison of Properties", Nov. 19, 2013, PolyFluoro Ltd.*
(Continued)

*Primary Examiner* — Dominick L Plakkoottam
(74) *Attorney, Agent, or Firm* — TraskBritt

(57) ABSTRACT

Reciprocating fluid pumps include a reinforced shaft including an inner shaft and a protective cover. The protective cover at least substantially encapsulates the inner shaft. The inner shaft exhibits a greater resistance to mechanical deformation than the protective cover, and the protective cover exhibits a greater resistance to chemical corrosion by the subject fluid than the inner shaft. Methods of forming a reciprocating fluid pump include forming a reinforced shaft and positioning the reinforced shaft within a subject fluid chamber and between two plungers.

26 Claims, 4 Drawing Sheets

(51) Int. Cl.
*F04B 53/14* (2006.01)
*F04B 43/02* (2006.01)

(58) Field of Classification Search
CPC ..... F04B 9/135; Y10T 29/49236; C10M 2213/062; F05C 2253/12; F16C 33/10
See application file for complete search history.

(56) References Cited

U.S. PATENT DOCUMENTS 5,370,507 A 12/1994 Dunn
5,558,506 A * 9/1996 Simmons ..... F01B 1/00 137/625.69
RE35,718 E * 1/1998 Nii ..... F16C 33/10 384/107
5,893,707 A 4/1999 Simmons et al.
5,967,173 A * 10/1999 Kingsford ..... F16K 11/048 137/312
6,106,246 A 8/2000 Steck et al.
6,131,910 A * 10/2000 Bagepalli ..... F01D 5/225 277/355
6,238,132 B1 * 5/2001 Plantan ..... B60T 17/083 403/230
6,295,918 B1 10/2001 Simmons et al.
6,441,741 B1 8/2002 Yoakum
6,685,443 B2 2/2004 Simmons et al.
7,458,309 B2 12/2008 Simmons et al.
8,262,366 B2 9/2012 Simmons et al.
8,672,645 B2 * 3/2014 Lin ..... F04B 43/026 137/625.69
2004/0058828 A1 * 3/2004 Iwata ..... C10M 111/04 508/104
2005/0191195 A1 * 9/2005 Oniduka ..... F04B 43/1136 417/473
2005/0222575 A1 * 10/2005 Ciccone ..... A61B 17/1615 606/104
2005/0276158 A1 * 12/2005 Thomas ..... B01F 7/22 366/250
2010/0019610 A1 1/2010 Saban et al.
2010/0178184 A1 7/2010 Simmons et al.
2012/0063924 A1 3/2012 Simmons et al.
2013/0243630 A1 * 9/2013 Simmons ..... F04B 23/028 417/456
2013/0306893 A1 * 11/2013 Naganuma ..... F02M 21/0242 251/129.11
2013/0315665 A1 * 11/2013 Heston ..... F16D 1/094 403/374.4
2013/0337221 A1 * 12/2013 Brahmandam ..... F16J 1/001 428/101

FOREIGN PATENT DOCUMENTS

JP 10-205482 A 8/1998
JP 10205482 A 8/1998
JP 2000-9091 A 1/2000
JP 2004-27883 A 1/2004
WO 83/04265 A1 12/1983

OTHER PUBLICATIONS

Taiwan Search Report of Patent Application No. 102142412 dated Sep. 21, 2015, 2 pages.
Japanese Office Action for Application No. 2013-240538 dated Jan. 20, 2015, 6 pages.
Japanese Office Action for Application No. 2013-240538 dated Nov. 30, 2015, 9 pages.
Japanese Search Report for Application No. 2013-240538 dated Dec. 11, 2014, 31 pages.

* cited by examiner

PNEUMATIC RECIPROCATING FLUID PUMP WITH REINFORCED SHAFT

CROSS-REFERENCE TO RELATED APPLICATION

This application claims the benefit of U.S. Provisional Patent Application Ser. No. 61/729,213, filed Nov. 21, 2012, the disclosure of which is hereby incorporated herein in its entirety by this reference.

TECHNICAL FIELD

Embodiments of the present disclosure relate generally to reciprocating fluid pumps, to components (including shafts) for use with such pumps, and to methods of fabricating such reciprocating fluid pumps and components.

BACKGROUND

Reciprocating fluid pumps are used in many industries. Reciprocating fluid pumps generally include two subject fluid chambers in a pump body for effecting movement of a volume of subject fluid. A reciprocating piston, which may also be characterized as a shaft, is driven back and forth within the pump body. One or more plungers (e.g., diaphragms or bellows) may be connected to the reciprocating piston or shaft. As the reciprocating piston moves in one direction, the movement of the plungers results in subject fluid being drawn into a first chamber of the two subject fluid chambers and expelled from the second chamber. As the reciprocating piston moves in the opposite direction, the movement of the plungers results in fluid being expelled from the first chamber and drawn into the second chamber. A fluid inlet and a fluid outlet may be provided in fluid communication with the first subject fluid chamber, and another fluid inlet and another fluid outlet may be provided in fluid communication with the second subject fluid chamber. The fluid inlets to the first and second subject fluid chambers may be in fluid communication with a common single pump inlet, and the fluid outlets from the first and second subject fluid chambers may be in fluid communication with a common single pump outlet, such that subject fluid may be drawn into the pump through the pump inlet from a single fluid source, and subject fluid may be expelled from the pump through a single pump outlet. Check valves may be provided at the fluid inlets and outlets to ensure that fluid can only flow into the subject fluid chambers through the fluid inlets, and fluid can only flow out of the subject fluid chambers through the fluid outlets.

Conventional reciprocating fluid pumps operate by shifting the reciprocating piston back and forth within the pump body. Shifting of the reciprocating piston from one direction to the other may be accomplished by using a shuttle valve, which provides drive fluid (e.g., pressurized air) to a first drive chamber associated with a first plunger and then shifts the drive fluid to a second drive chamber associated with a second plunger as the first plunger reaches a fully extended position. The shuttle valve includes a spool that shifts from a first position that directs the drive fluid to the first drive chamber to a second position that directs the drive fluid to the second drive chamber. Shifting of the shuttle valve spool may be accomplished by providing fluid communication between the drive chamber and a shift conduit when each plunger is fully extended, which enables the drive fluid to pressurize the shift conduit to shift the shuttle valve spool from one position to the other. During the rest of the pumping stroke, however, the opening to the shift conduit is kept sealed from the drive chamber to keep the shuttle valve spool from prematurely shifting and to improve the efficiency of the reciprocating fluid pump.

Examples of reciprocating fluid pumps and components thereof are disclosed in, for example: U.S. Pat. No. 5,370,507, which issued Dec. 6, 1994 to Dunn et al.; U.S. Pat. No. 5,558,506, which issued Sep. 24, 1996 to Simmons et al.; U.S. Pat. No. 5,893,707, which issued Apr. 13, 1999 to Simmons et al.; U.S. Pat. No. 6,106,246, which issued Aug. 22, 2000 to Steck et al.; U.S. Pat. No. 6,295,918, which issued Oct. 2, 2001 to Simmons et al.; U.S. Pat. No. 6,685,443, which issued Feb. 3, 2004 to Simmons et al.; U.S. Pat. No. 7,458,309, which issued Dec. 2, 2008 to Simmons et al.; and U.S. Patent Application Publication No. 2010/0178184 A1, which published Jul. 15, 2010 in the name of Simmons et al. The disclosure of each of these patents and patent application is respectively incorporated herein in its entirety by this reference.

SUMMARY

In some embodiments, the present disclosure includes pneumatic reciprocating fluid pumps for pumping a subject fluid, the pumps including first and second subject fluid chambers, first and second plungers, and a reinforced shaft extending between the first plunger and the second plunger. The first plunger is configured and positioned to expand and contract a volume of the first subject fluid chamber. The second plunger is configured and positioned to expand and contract a volume of the second subject fluid chamber. The reinforced shaft includes an inner shaft and a protective cover at least substantially encapsulating the inner shaft. The inner shaft exhibits a greater resistance to mechanical deformation than the protective cover, and the protective cover exhibits a greater resistance to chemical corrosion by the subject fluid than the inner shaft.

In some embodiments, the present disclosure includes methods of forming a reciprocating fluid pump for pumping a subject fluid. In accordance with such methods, a reinforced shaft is formed by at least substantially encapsulating an inner shaft comprised of a first material with a protective covering comprised of a second material different than the first material. The reinforced shaft is positioned at least partially within one or both of a first subject fluid chamber and a second subject fluid chamber and between a first plunger at least partially defining the first subject fluid chamber and a second plunger at least partially defining the second subject fluid chamber.

In some embodiments, the present disclosure includes reinforced shafts for reciprocating fluid pumps for pumping a subject fluid. The reinforced shafts include an inner shaft and a protective cover. The inner shaft exhibits a first mechanical stability and a first chemical stability when exposed to the subject fluid. The protective cover exhibits a second mechanical stability less than the first mechanical stability and a second chemical stability when exposed to the subject fluid greater than the first chemical stability when exposed to the subject fluid.

DETAILED DESCRIPTION

The illustrations presented herein may not be, in some instances, actual views of any particular reciprocating fluid pump or component thereof, but may be merely idealized representations that are employed to describe embodiments of the present invention. Additionally, elements common between drawings may retain the same numerical designation.

As used herein, the term "substantially" in reference to a given parameter means to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90% met, at least 95% met, or even at least 99% met.

As used herein, any relational term, such as "first," "second," "left," "right," etc., is used for clarity and convenience in understanding the disclosure and accompanying drawings and does not connote or depend on any specific preference, orientation, or order, except where the context clearly indicates otherwise.

Embodiments of the present disclosure include pumps and components for pumps for pumping a subject fluid. In some embodiments, a reinforced shaft is disclosed, which includes an inner shaft and a protective cover at least substantially encompassing the inner shaft. The inner shaft may be more mechanically stable than the protective cover, in that the inner shaft may exhibit a resistance to deformation in the conditions to which the reinforced shaft is subjected that is higher than a resistance to deformation of the protective cover. The protective cover may be more chemically stable than the inner shaft, in that the protective cover may exhibit a resistance to chemical corrosion by or contamination of the subject fluid to be pumped by the pump. Thus, in some embodiments, the reinforced shaft of the present disclosure may exhibit improved mechanical stability in operating conditions of the pump, without compromising chemical stability thereof.

Figure 1:
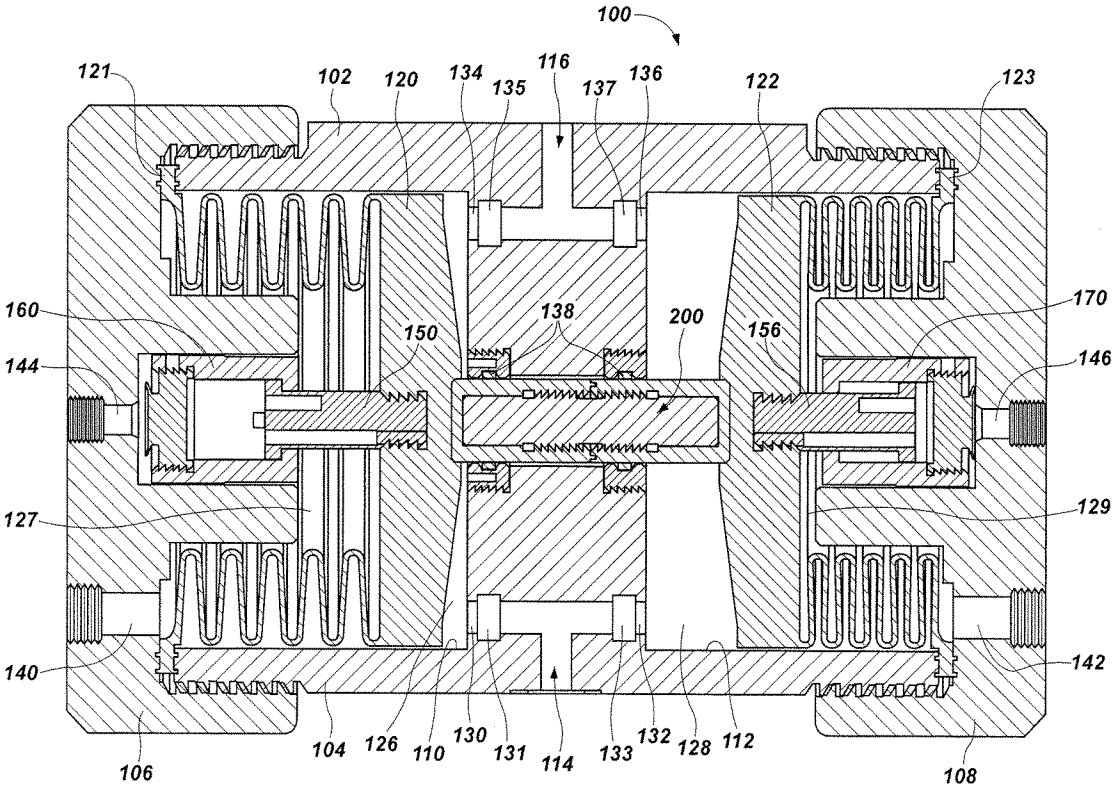
FIG. 1 is a schematically illustrated cross-sectional view of a pump according to an embodiment of the present disclosure.

FIG. 1 is a schematically illustrated cross-sectional view of a pump 100 according to an embodiment of the present disclosure. In some embodiments, the pump 100 is configured to pump a subject fluid, such as, for example, a liquid (e.g., water, oil, acid, etc.), gas, or powdered substance, using a pressurized drive fluid, such as, for example, compressed gas (e.g., air). Thus, in some embodiments, the pump 100 may comprise a pneumatically operated pump, such as a pneumatic reciprocating fluid pump.

A pump body 102 of the pump 100 may include two or more components that may be assembled together to fours the pump body 102. For example, the pump body 102 may include a center body 104, a first end piece 106 that may be attached to the center body 104 on a first side thereof, and a second end piece 108 that may be attached to the center body 104 on an opposite, second side thereof.

The pump body 102 may include therein a first cavity 110 and a second cavity 112. A first plunger 120 may be disposed within the first cavity 110, and a second plunger 122 may be disposed within the second cavity 112. In some embodiments, the plungers 120, 122 may each be formed of and comprise a flexible polymer material (e.g., an elastomer or a thermoplastic material). As discussed in further detail below, each of the plungers 120, 122 may comprise, for example, a diaphragm or a bellows, such that the plungers 120, 122 may be longitudinally extended and compressed as the pump 100 is cycled (i.e., in the left and right horizontal directions from the perspective of FIG. 1) during operation thereof. The first plunger 120 may divide the first cavity 110 into a first subject fluid chamber 126 on a first side of the first plunger 120 and a first drive fluid chamber 127 on an opposite, second side of the first plunger 120. Similarly, the second plunger 122 may divide the second cavity 112 into a second subject fluid chamber 128 on a first side of the second plunger 122 and a second drive fluid chamber 129 on an opposite, second side of the second plunger 122. Thus, the first subject fluid chamber 126 may be at least partially defined by the first plunger 120, and the second subject fluid chamber 128 may be at least partially defined by the second plunger 122.

A peripheral edge 121 of the first plunger 120 may be attached to the pump body 102, and a fluid-tight seal may be provided between the pump body 102 and the first plunger 120 to separate subject fluid in the first subject fluid chamber 126 from drive fluid in the drive fluid chamber 127. Similarly, a peripheral edge 123 of the second plunger 122 may be attached to the pump body 102, and a fluid-tight seal may be provided between the pump body 102 and the second plunger 122. The pump 100 may include a main subject fluid inlet 114 and a main subject fluid outlet 116. During operation of the pump 100, subject fluid may be drawn into the pump 100 through the main subject fluid inlet 114 and expelled out from the pump 100 through the main subject fluid outlet 116.

Although FIG. 1 illustrates each of the first and second plungers 120, 122 as a bellows, the present disclosure is not so limited. For example, each of the first and second plungers 120, 122 may be a bellows, a piston, a diaphragm, or any other structure that may be extended and compressed to alter a volume of the first and second subject fluid chambers 126, 128, respectively. By way of example and not limitation, pumps with plungers in the form of diaphragms are disclosed in U.S. Pat. No. 8,262,366, titled "PISTON SYSTEMS HAVING A FLOW PATH BETWEEN PISTON CHAMBERS, PUMPS INCLUDING A FLOW PATH BETWEEN PISTON CHAMBERS, AND METHODS OF DRIVING PUMPS," issued Sep. 11, 2012 to Simmons et al., the disclosure of which is incorporated herein in its entirety by this reference.

A first subject fluid inlet 130 may be provided in the pump body 102 that leads from the main subject fluid inlet 114 into the first subject fluid chamber 126 through the pump body 102, and a first subject fluid outlet 134 may be provided in the pump body 102 that leads out from the first subject fluid chamber 126 to the main subject fluid outlet 116 through the pump body 102. Similarly, a second subject fluid inlet 132 may be provided in the pump body 102 that leads from the main subject fluid inlet 114 into the second subject fluid chamber 128 through the pump body 102, and a second subject fluid outlet 136 may be provided in the pump body 102 that leads out from the second subject fluid chamber 128 to the main subject fluid outlet 116 through the pump body 102.

A first inlet check valve 131 may be provided proximate the first subject fluid inlet 130 to ensure that subject fluid is capable of flowing into the first subject fluid chamber 126 through the first subject fluid inlet 130, but incapable of or restricted from flowing back from the first subject fluid chamber 126 through the first subject fluid inlet 130 into the main subject fluid inlet 114. A first outlet check valve 135 may be provided proximate the first subject fluid outlet 134 to ensure that subject fluid is capable of flowing out from the first subject fluid chamber 126 through the first subject fluid outlet 134, but incapable of or restricted from flowing back into the first subject fluid chamber 126 from the main subject fluid outlet 116. Similarly, a second inlet check valve 133 may be provided proximate the second subject fluid inlet 132 to ensure that subject fluid is capable of flowing into the second subject fluid chamber 128 through the second subject fluid inlet 132, but incapable of or restricted from flowing back from the second subject fluid chamber 128 through the second subject fluid inlet 132 into the main subject fluid inlet 114. A second outlet check valve 137 may be provided proximate the second subject fluid outlet 136 to ensure that subject fluid is capable of flowing out from the second subject fluid chamber 128 through the second subject fluid outlet 136, but incapable of, or restricted from, flowing back into the second subject fluid chamber 128 from the main subject fluid outlet 116.

In some embodiments, the subject fluid inlets 130, 132 respectively leading to the first subject fluid chamber 126 and the second subject fluid chamber 128 may be in fluid communication with the main subject fluid inlet 114, and the subject fluid outlets 134, 136 respectively leading out from the first subject fluid chamber 126 and the second subject fluid chamber 128 may be in fluid communication with the main subject fluid outlet 116, such that subject fluid may be drawn into the pump 100 through the main subject fluid inlet 114 from a single fluid source, and subject fluid may be expelled from the pump 100 through the main subject fluid outlet 116.

In the configuration described above, the first plunger 120 may be capable of extending in the rightward direction and compressing in the leftward direction from the perspective of FIG. 1. Similarly, the second plunger 122 may be capable of extending in the leftward direction and compressing in the rightward direction from the perspective of FIG. 1. The first plunger 120 and the second plunger 122 may be coupled to a reinforced shaft 200 such that the first plunger 120 extends as the second plunger 122 compresses and the first plunger 120 compresses as the second plunger 122 extends. Embodiments of the reinforced shaft 200 are described herein with reference to FIGS. 2 through 7. The reinforced shaft 200 may extend through a portion of the pump body 102, such as through a bore formed in the center body 104 of the pump body 102. A fluid-tight seal may be provided between the reinforced shaft 200 and the pump body 102 with, for example, one or more seals 138 (e.g., O-rings), to inhibit subject fluid from communicating between the first and second subject fluid chambers 126, 128 through the pump body 102 around the reinforced shaft 200. At any given time during operation, the reinforced shaft 200 may be positioned at least partially within one or both of the first and second subject fluid chambers 126, 128. Thus, the reinforced shaft 200 may be exposed to subject fluid during operation of the pump 100.

In some embodiments, the reinforced shaft 200 may be rigidly coupled (e.g., connected, fastened) to the first and second plungers 120, 122, such as by adhering the reinforced shaft 200 to the first and second plungers 120, 122, by threading ends of the reinforced shaft 200 into or onto the first and second plungers 120, 122, or by otherwise providing mechanical interference between the reinforced shaft 200 and the first and second plungers 120, 122. In other embodiments, the reinforced shaft 200 may not be rigidly coupled (e.g., connected, fastened) to the first and second plungers 120, 122. For example, pumping forces from the drive fluid and/or vacuum forces of the subject fluid or drive fluid may cause the first and second plungers 120, 122 to push against the reinforced shaft 200 to maintain engagement with the reinforced shaft 200 during operation.

As the first plunger 120 extends and the second plunger 122 compresses, the volume of the first drive fluid chamber 127 increases, the volume of the first subject fluid chamber 126 decreases, the volume of the second subject fluid chamber 128 increases, and the volume of the second drive fluid chamber 129 decreases. As a result, subject fluid may be expelled from the first subject fluid chamber 126 through the first subject fluid outlet 134, and subject fluid may be drawn into the second subject fluid chamber 128 through the second subject fluid inlet 132. The first plunger 120 may be extended and the second plunger 122 may be compressed by providing pressurized drive fluid within the first drive fluid chamber 127 through one or more first drive fluid lines 140, as will be explained in more detail below. A first shift conduit 144 may also be in fluid communication with the first drive fluid chamber 127 at least during a portion of a cycle of the pump 100, such as when the first plunger 120 is fully extended to the right, when viewed in the perspective of FIG. 1, as will be explained in more detail below.

Conversely, as the second plunger 122 extends and the first plunger 120 compresses, the volume of the second drive fluid chamber 129 increases, the volume of the second subject fluid chamber 128 decreases, the volume of the first subject fluid chamber 126 increases, and the volume of the first drive fluid chamber 127 decreases. As a result, subject fluid may be expelled from the second subject fluid chamber 128 through the second subject fluid outlet 136, and subject fluid may be drawn into the first subject fluid chamber 126 through the first subject fluid inlet 130. The second plunger 122 may be extended and the first plunger 120 may be compressed by providing pressurized drive fluid within the second drive fluid chamber 129 through one or more second drive fluid lines 142, as will be explained in more detail below. A second shift conduit 146 may also be in fluid communication with the second drive fluid chamber 129 at least during a portion of a cycle of the pump 100, such as when the second plunger 122 is fully extended to the left, when viewed in the perspective of FIG. 1.

In some embodiments, the pump body 102 and other components of the pump 100 may be at least substantially comprised of at least one polymer material, such as a polymer material that is selected to be resistant to corrosion by and/or to contamination of the subject fluid to be pumped by the pump 100. For example, the pump 100 may be used to pump a corrosive subject fluid, such as an acid solution comprising one or more of hydrochloric acid (HCl), sulfuric acid ($H_2SO_4$), hydrofluoric acid (HF), etc. Such corrosive subject fluids may tend to corrode some materials that are typically used in fluid pumps, such as metals. Thus, pumps having metallic components exposed to the subject fluid may tend to be damaged or even fail completely when pumping corrosive subject fluids. In addition, the subject fluids pumped by the pump 100 may, in some embodiments, be used for manufacturing (e.g., semiconductor manufacturing) or other applications that require a high purity subject fluid. Thus, a pump that includes materials and components that may be corroded by the subject fluid may undesirably contaminate the subject fluid.

By way of example and not limitation, components of the pump 100 may be at least substantially comprised of a polymer material that may comprise one or more of a fluoropolymer, a fluoropolymer elastomer (e.g., VITON®), neoprene, buna-N, ethylene propylene diene monomer M-class (EPDM) (e.g., NORDEL®), polyurethane, a thermoplastic polyester elastomer (e.g., HYTREL®), a thermoplastic vulcanizate (TPV) (e.g., SANTOPRENE®), fluorinated ethylene-propylene (FEP), a fluorocarbon resin, perfluoroalkoxy (PFA), ethylene-chlorotrifluoroethylene copolymer (ECTFE) (e.g., HALAR®), ethylene-tetrafluoroethylene copolymer (ETFE) (e.g., TEFZEL®), nylon, polyethylene, polyvinylidene fluoride (PVDF) (e.g., KYNAR®), polytetrafluoroethylene (PTFE) (e.g., TEFLON®), chlorotrifluoroethylene (CTFE) (e.g., KEL-F®), nitrile, and any other fully or partially fluorinated polymer. Thus, the particular material(s) used for components of the pump 100 may depend on the particular subject fluid or variety of subject fluids to be pumped with the pump 100. For example, in one embodiment in which a sulfuric acid ($H_2SO_4$) solution is to be pumped with the pump 100, the components of the pump 100 or portions thereof exposed to the subject fluid may be at least substantially comprised of a PFA material, which is generally resistant to corrosion by sulfuric acid.

As noted above, the first drive fluid chamber 127 may be pressurized with drive fluid supplied through one or more of the first drive fluid lines 140 during operation of the pump 100. The pressurized drive fluid may push the first plunger 120 to the right (from the perspective of FIG. 1). As the first plunger 120 moves to the right, the second drive fluid chamber 129 may be depressurized and the second plunger 122 may be pushed to the right by the first plunger 120 through the reinforced shaft 200. The second drive fluid chamber 129 may be depressurized by venting to ambient or by providing a reduced pressure therein through at least one of the second drive fluid lines 142 and the second shift conduit 146. As the first plunger 120 and the second plunger 122 move to the right (from the perspective of FIG. 1), any subject fluid within the first subject fluid chamber 126 may be expelled from the first subject fluid chamber 126 through the first subject fluid outlet 134, and subject fluid will be drawn into the second subject fluid chamber 128 through the second subject fluid inlet 132.

As the first plunger 120 approaches its fully-extended position (i.e., to the right when viewed in the perspective of FIG. 1), the operation just described may be reversed. For example, the second drive fluid chamber 129 may be pressurized with pressurized drive fluid supplied through one or more of the second drive fluid lines 142, which will push the second plunger 122 to the left (from the perspective of FIG. 1). As the second plunger 122 moves to the left, the first drive fluid chamber 127 may be depressurized (e.g., vented to ambient, subjected to a reduced pressure) and the first plunger 120 may be pushed to the left by the second plunger 122 through the reinforced shaft 200. The first drive fluid chamber 127 may be depressurized through at least one of the first drive fluid lines 140 and the first shift conduit 144. As the first plunger 120 and the second plunger 122 move to the left (from the perspective of FIG. 1), subject fluid within the second subject fluid chamber 128 will be expelled from the second subject fluid chamber 128 through the second subject fluid outlet 136, and subject fluid will be drawn into the first subject fluid chamber 126 through the first subject fluid inlet 130.

Thus, to drive the pumping action of the pump 100, the first drive fluid chamber 127 and the second drive fluid chamber 129 may be pressurized in an alternating or cyclic manner to cause the first plunger 120, the second plunger 122, and the reinforced shaft 200 to reciprocate back and forth within the pump body 102, as discussed above.

The pump 100 may comprise a shifting mechanism for shifting the flow of pressurized drive fluid back and forth between the first drive fluid chamber 127 and the second drive fluid chamber 129. The shifting mechanism may include, for example, one or more shill pistons 150, 156, one or more shift canister assemblies 160, 170, and a shuttle valve (not shown). By way of example and not limitation, a shuttle valve suitable for use with the pump 100 is disclosed in U.S. patent application Ser. No. 12/684,528, titled "BELLOWS PLUNGERS HAVING ONE OR MORE HELICALLY EXTENDING FEATURES, PUMPS INCLUDING SUCH BELLOWS PLUNGERS, AND RELATED METHODS," filed. Jan. 8, 2010, now U.S. Pat. No. 8,636,484 (hereinafter "the '484 patent"), issued Jan. 28, 2014), and U.S. patent application Ser. No. 13/228,934, titled "RECIPROCATING FLUID PUMPS INCLUDING MAGNETS, DEVICES INCLUDING MAGNETS FOR USE WITH RECIPROCATING FLUID PUMPS, AND RELATED METHODS," filed Sep. 9, 2011, now U.S. Pat. No. 8,622,720, issued Jan. 7, 2014, the disclosure of each of which is incorporated herein in its entirety by this reference.

Examples of pumps with shift canisters and example descriptions of their operation are disclosed in, for example, U.S. patent application Ser. No. 13/420,978, titled "RECIPROCATING PUMPS AND RELATED METHODS," filed Mar. 15, 2012, now U.S. Pat. No. 9,360,000, issued Jun. 6, 2016, the disclosure of which is incorporated herein in its entirety by this reference. By way of example and not limitation, the first shift piston 150 may be coupled to the first plunger 120, such as by threads, an adhesive, a press fit, mechanical interference, etc., or the first shift piston 150 may be an integral part of the first plunger 120. The first shift piston 150 may comprise an elongated, generally cylindrical body that is oriented generally parallel to an axis along which the first plunger 120 extends and compresses. When the pump 100 is assembled, the first shift piston 150 may be at least partially disposed within the first shift canister 160 to couple (e.g., slidably couple) the first plunger 120 to the first shift canister 160. As the first plunger 120 approaches a fully extended position, as shown in FIG. 1, the first shift piston 150 may be configured to move the first shift canister 160 such that the first shift canister 160 uncovers the first shift conduit 144 and enables fluid communication between the first shift conduit 144 and the first drive fluid chamber 127. When pressurized drive fluid within the first drive fluid chamber 127 flows into the first shift conduit 144, an associated shuttle valve may be shifted to direct drive fluid to the second drive fluid chamber 129 and to vent or draw drive fluid from the first drive fluid chamber 127. The second shift piston 156 and the second shift canister 170 may be configured to operate in a similar manner to the first shift piston 150 and the first shift canister 160.

Although not shown in the drawings, a shuttle valve may be operatively connected to the first and second drive fluid lines 140, 142 and to the first and second shift conduits 144, 146 of the pump 100 for alternately shifting flow of pressurized drive fluid between the first and second drive fluid chambers 127, 129. Such shuttle valves are well known in the art of reciprocating pumps and are, therefore, not shown or described in detail in the present disclosure. As noted above, an example shuttle valve that may be suitable for use with the pump of the present disclosure is disclosed in the '484 patent. In general terms, the shuttle valve may include a spool that shifts from a first position to a second position. In the first position, pressurized drive fluid is supplied through the shuttle valve and into the first drive fluid lines 140 and drive fluid is allowed to escape from the second drive fluid chamber 129 through at least one of the second drive fluid lines 142 and the second shift conduit 146. Thus, while the spool of the shuttle valve is in the first position, the pressurized drive fluid forces the first and second plungers 120, 122 to the right, when viewed in the perspective of FIG. 1, as described above. In the second position, pressurized drive fluid is supplied through the shuttle valve and into the second drive fluid lines 142 and drive fluid is allowed to escape from the first drive fluid chamber 127 through at least one of the first drive fluid lines 140 and the first shift conduit 144. Thus, while the spool of the shuttle valve is in the second position, the pressurized drive fluid forces the first and second plungers 120, 122 to the left, when viewed in the perspective of FIG. 1, as described above.

To facilitate a complete understanding of operation of the pump 100 and the associated shift mechanism, a complete pumping cycle of the pump 100 (including a rightward stroke and a leftward stroke of each of the plungers 120, 122) is described below with reference to FIG. 1.

A pumping cycle may begin with the internal components of the pump 100 in the position shown in FIG. 1. In other words, the first plunger 120 may be fully extended and the second plunger 122 may be fully compressed to the right in the perspective of FIG. 1. As described above, pressurized drive fluid may be introduced into the second drive fluid chamber 129 through the second drive fluid line 142 to force the second plunger 122 to the left along with the first plunger 120, which is pushed by the second plunger 122 through the reinforced shaft 200.

As the second plunger 122 approaches its fully extended position (i.e., to the left when viewed in the perspective of FIG. 1), the second shift piston 156 may move the second shift canister assembly 170 to the left (when viewed in the perspective of FIG. 1) to unseal the second shift canister assembly 170 from against the pump body 102 and to enable fluid communication between the second drive fluid chamber 129 and the second shift conduit 146. Drive fluid may flow from the second drive fluid chamber 129 into the second shift conduit 146 and the pressure therein may increase. Such pressure may force the shuttle valve to shift. When the shuttle valve shifts, drive fluid may be directed to the first drive fluid line 140 and the second drive fluid line 142 may be depressurized by, for example, venting to ambient, being subjected to reduced pressure, etc. As described above, such shifting of drive fluid pressure may cause the first and second plungers 120, 122 to move in the opposite direction (i.e., to the right when viewed in the perspective of FIG. 1) to extend the first plunger 120 and compress the second plunger 122. After the second plunger 122 compresses a short distance, the force of the second shift piston 156 against the second shift canister assembly 170 may be released. Thus, the second shift canister assembly 170 may be free to move back into a position in which the second shift canister assembly 170 abuts against the pump body 102 to form a seal around an interior opening of the second shift conduit 146 responsive to, for example, pressurized drive fluid being introduced into the second drive fluid chamber 129.

As shown in FIG. 1, as the first plunger 120 approaches a fully extended position, the first shift piston 150 engages with the first shift canister assembly 160 and forces (pulls) the first shift canister assembly 160 to the right to unseal the first shift canister assembly 160 from against the pump body 102. The first shift conduit 144 may, as a result, be exposed to pressure from the first drive fluid chamber 127 in a similar manner to that described above with reference to the second shift conduit 146. The shuttle valve may be shifted back responsive to the pressure in the first shift conduit 144. After the shuttle valve shifts back, pressurized drive fluid may again be introduced into the second drive fluid chamber 129 and the first drive fluid lines 140 may be depressurized to depressurize the first drive fluid chamber 127. At this point, the pump 100 is back in the position shown in FIG. 1, which completes one full cycle of the pump 100. This reciprocating action may be repeated, which may result in at least substantially continuous flow of subject fluid through the pump 100.

The repeated reciprocating action of the pump 100 may cause cyclical loading of components of the pump 100. For example, the reinforced shaft 200 may be repeatedly compressed as the first and second plungers 120, 122 push against each other through the reinforced shaft 200 responsive to pressurized drive fluid being introduced into the respective first and second drive fluid chambers 127, 129. Thus, the reinforced shaft 200 may be reinforced with an inner shaft that provides mechanical stability to the reinforced shaft 200 to inhibit physical deformation of the reinforced shaft 200 that may otherwise result from the repeated compressions. The reinforced shaft 200 may have a protective cover, which may include one or more portions, that is at least substantially comprised of a material resistant to corrosion by and contamination of the subject fluid to be pumped by the pump 100. Since the inner shaft is covered by the protective cover, the material of the inner shaft may be selected for its mechanical properties, even though the material of the inner shaft may be otherwise less desirable due to its reduced chemical stability in the presence of the subject fluid. Example embodiments of the reinforced shaft 200 are shown in FIGS. 2 through 7 and are described below.

Figure 2:
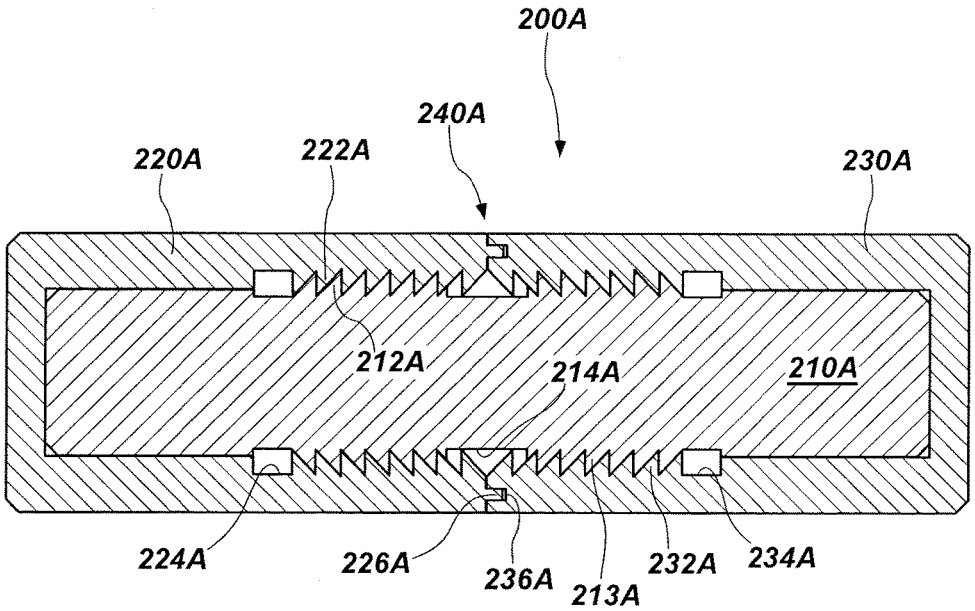
FIG. 2 is an enlarged cross-sectional view of a reinforced shaft of the pump of FIG. 1 according to an embodiment of the present disclosure.

Referring to FIG. 2, an embodiment of a reinforced shaft 200A is shown that includes an inner shaft 210A, a first protective cover portion 220A, and a second protective cover portion 230A. The first and second protective cover portions 220A, 230A may substantially entirely cover (e.g., encapsulate) the inner shaft 210A. The first and second protective cover portions 220A, 230A are also referred to collectively as a protective cover 220A, 230A.

The inner shaft 210A may have an elongated shape. In some embodiments, such as the embodiment shown in FIG. 2, the inner shaft 210A may be generally cylindrical. At least a portion of an outer side surface of the inner shaft 210A may include threads 212A, 213A for coupling the protective cover portions 220A, 230A to the inner shaft 210A. One or more recesses 214A may also be formed on the outer side surface of the inner shaft 210A as a result of a thread-forming process used to form the threads 212A, 213A. Although two separate threads 212A and 213A are shown in FIG. 2 for respectively coupling the first protective cover portion 220A and the second protective cover portion 230A to the inner shaft 210A, in other embodiments, the inner shaft 210A may include a single, continuous thread extending along at least a portion of the outer surface thereof to which both of the first and second protective cover portions 220A, 230A may be engaged.

The first protective cover portion 220A may include threads 222A that are complementary to the threads 212A of the inner shaft 210A for coupling the first protective cover portion 220A to the inner shaft 210A. In some embodiments, the inner shaft 210A may include an annular recess 224A, which may be formed as a result of a thread-forming process used to form the threads 222A. Similarly, the second protective cover portion 230A may include threads 232A that are complementary to the threads 213A of the inner shaft 210A for coupling the second protective cover portion 230A to the inner shaft 210A. The second protective cover portion 230A may also include an annular recess 234A, which may be formed as a result of a thread-forming process used to form the threads 232A.

An interface 240A between the first protective cover portion 220A and the second protective cover portion 230A may be sealed to inhibit subject fluid from leaking through the interface 240A between one or both of the first and second subject fluid chambers 126 and 128 (FIG. 1) and the inner shaft 210A. By way of non-limiting example, the interface 240A may be sealed using a tongue and groove joint, an O-ring, a weld, a face-to-face abutment, a gasket, and/or an adhesive (e.g., an adhesive resistant to corrosion by or contamination of the subject fluid). For example, as shown in FIG. 2, a tongue and groove joint may be provided by forming the first protective cover 220A to include an annular protrusion 226A configured to fit (e.g., snugly fit) at least partially within a complementary annular groove 236A formed in the second protective cover portion 230A.

As noted above, the inner shaft 210A may be at least substantially comprised of a material selected to exhibit mechanical stability and resistance to deformation under repeated compressions of the reinforced shaft 200A. The inner shaft 210A may exhibit a greater mechanical stability and resistance to deformation than the material of the protective cover 220A, 230A under the operating conditions of the pump 100. Thus, in some embodiments, the inner shaft 210A may be formed of a high strength engineered plastic or a metal. For example, the inner shaft 210A may exhibit reduced mechanical creep, mechanical fatigue, permanent bending, permanent compression in a longitudinal direction and expansion in a radial direction, etc. Although the inner shaft 210A may generally be protected from exposure to the subject fluid by the protective cover 220A, 230A, the material of the inner shaft 210A may be selected to exhibit some level of chemical stability when exposed to the subject fluid to inhibit corrosion by or contamination of the subject fluid in case the subject fluid permeates through the protective cover 220A, 230A to some degree. By way of example and not limitation, the material of the inner shaft 210A may be one or more of polyether ether ketone (PEEK), polyether ketone (PEK), ETFE, CTFE, ECTFE, PVDF, stainless steel, and any metal alloy having a high nickel content (e.g., higher than about 40% by mass nickel) (e.g., HASTELLOY®, INCONEL®, MONEL®, etc.). In some embodiments, for example, the inner shaft 210A may be substantially comprised of one of PEEK and PEK.

As further noted above, the protective cover 220A, 230A may be at least substantially comprised of a material selected to exhibit chemical stability when exposed to the subject fluid. The protective cover 220A, 230A may exhibit a greater chemical stability and resistance to corrosion by and contamination of the subject fluid than the material of the inner shaft 210A. The material of the protective cover 220A, 230A may be selected depending on the subject fluid to be pumped by the pump 100. By way of example and not limitation, the material of the protective cover 220A, 230A may be one or more of a fluoropolymer, a fluoropolymer elastomer, neoprene, buna-N, EPDM, polyurethane, a thermoplastic polyester elastomer, a TPV, FEP, a fluorocarbon resin, PFA, ECTFE, ETFE, nylon, polyethylene, PVDF, PTFE, CTFE, nitrile, and any other fully or partially fluorinated polymer. For example, in some embodiments, the first and second protective cover portions 220A, 230A may be substantially comprised of one of PFA, PTFE, ETFE, CTFE, ECTFE, and PVDF. In one example embodiment, the first and second protective cover portions may be substantially comprised of PFA.

Figure 3:
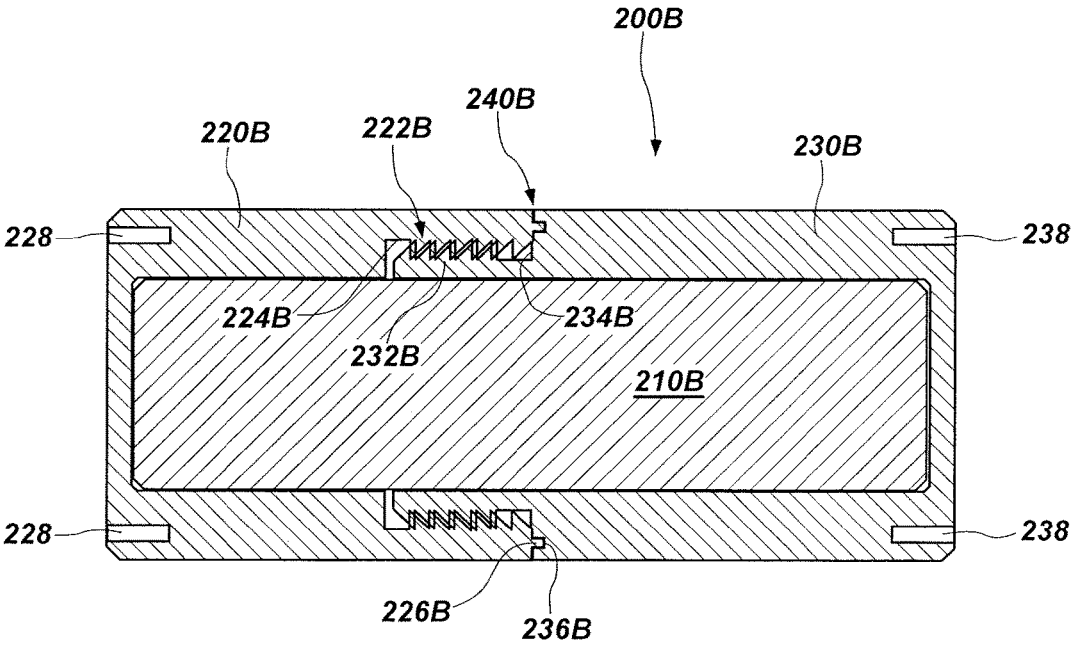
FIG. 3 is an enlarged cross-sectional view of a reinforced shaft according to another embodiment of the present disclosure.

Referring to FIG. 3, another embodiment of a reinforced shaft 200B is shown that includes an inner shaft 210B, a first protective cover portion 220B, and a second protective cover portion 230B. The first and second protective cover portions 220B, 230B may substantially entirely cover (e.g., encapsulate) the inner shaft 210B. The first and second protective cover portions 220B, 230B are also referred to collectively as a protective cover 220B, 230B.

The inner shaft 210B of FIG. 3 may be similar to the inner shaft 210A of FIG. 2 in material composition and in general physical form. However, the inner shaft 210B may lack threads on an outer surface thereof, and the outer surface may be generally cylindrical, as shown in FIG. 3.

The protective cover 220B, 230B of FIG. 3 may be similar to the protective cover 220A, 230A of FIG. 2 in material composition and in outer shape. However, the first protective cover portion 220B may include a thread 222B that is complementary to a thread 232B of the second protective cover portion 230B, as shown in FIG. 3. Recesses 224B and 234B may be formed proximate the respective threads 222B and 232B as a result of the thread-forming process. The thread 222B of the first protective cover portion 220B may be recessed from an inner surface thereof to provide space in which a portion of the second protective cover portion 230B including the thread 232B may be disposed when coupled (e.g., threaded) together. Similarly, the thread 232B of the second protective cover portion 230B may be recessed from an outer surface thereof to provide space for a portion of the first protective cover portion 220B including the thread 222B when coupled together. To facilitate coupling (e.g., threading) the first and second protective cover portions 220B, 230B together, an end of the first protective cover portion 220B may include two or more recesses 228 therein and an end of the second protective cover portion 230B may also include two or more recesses 238 therein. To couple the first and second protective cover portions 220B, 230B together, one or more tools having two or more protrusions complementary to the recesses 228, 238 may be used. For example, the two or more protrusions of the one or more tools may be inserted into the recesses 228, 238, and the one or more tools may be rotated to thread the first and second protective cover portions 220B, 230B together. Although not shown in the view of FIG. 2, similar recesses may be provided in the first and second protective cover portions 220A and 230A of FIG. 2 to facilitate coupling the first protective cover portion 220A and the second protective cover portion 230A to the inner shaft 210A.

With continued reference to FIG. 3, an interface 240B between the first and second protective cover portions 220B, 230B may include one or more sealing features to provide a fluid seal at the interface 240B. For example, the first protective cover portion 220B may include an annular protrusion 226B and the second protective cover portion 230B may include a complementary annular groove 236B, which may be used to form a tongue and groove joint and to inhibit subject fluid from leaking through the interface 240B. Of course, the interface 240B may be sealed using other methods, such as one or more of those listed above with reference to FIG. 2.

Figure 4:
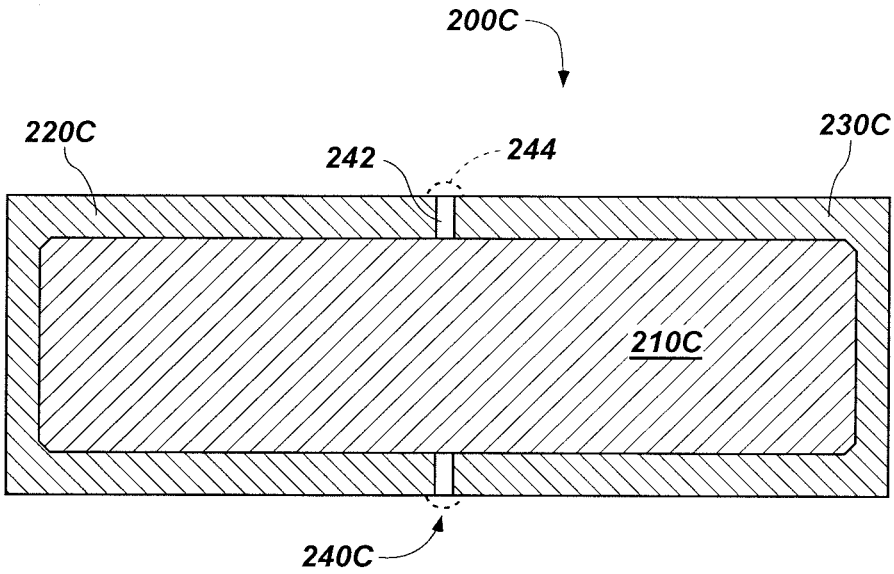
FIG. 4 is an enlarged cross-sectional view of a reinforced shaft according to another embodiment of the present disclosure.

Referring to FIG. 4, another embodiment of a reinforced shaft 200C is shown that includes an inner shaft 210C, a first protective cover portion 220C, and a second protective cover portion 230C. The first and second protective cover portions 220C, 230C may substantially entirely cover (e.g., encapsulate) the inner shaft 210C. The first and second protective cover portions 220C, 230C are also referred to collectively as a protective cover 220C, 230C.

The inner shaft 210C of FIG. 4 may be similar to the inner shaft 210B of FIG. 3 in material composition and in general physical form. The protective cover 220C, 230C of FIG. 4 may be similar to the protective cover 220A, 230A of FIG. 2 in material composition and in outer shape. However, the first protective cover portion 220C and the second protective cover portion 230C may lack threads. Instead, the reinforced shaft 200C may include a weld 242 at an interface 240C between the first and second protective cover portions 220C, 230C for coupling the first protective cover portion 220C to the second protective cover portion 230C, and for coupling the protective cover 220C, 230C to the inner shaft 210C. By way of example and not limitation, material of the weld 242 may be the same as the material of the protective cover 220C, 230C.

In some embodiments, the weld 242 may be formed by introducing molten material into the interface 240C. If a bead 244 (shown in FIG. 4 in broken lines) is formed around the weld 242 from introducing excess molten material into the interface 240C, such a bead 244 may be removed, such as by grinding or otherwise machining the bead 244 away, prior to installation within a pump. In other embodiments, the weld 242 may be formed by melting material of one or both of the first protective cover portion 220C and the second protective cover portion 230C at the interface 240C, without introducing material into the interface 240C. For example, the first and second protective cover portions 220C, 230C may be positioned around the inner shaft 210C and may be abutted against each other at the interface 240C, after which material proximate the interface 240C may be exposed to an elevated temperature to melt the material proximate the interface 240C. The particular elevated temperature to which the material proximate the interface 240C is exposed may depend on a melting point of the material that is selected for the first and second protective cover portions 220C, 230C. The material proximate the interface 240C may be exposed to the elevated temperature by heating only an area proximate the interface 240C or by heating the entire protective cover 220C, 230C, such as in a furnace or oven.

Although specific examples that include certain sealing features are shown and described herein, the various sealing features may be present in additional combinations. For example, a weld like the weld 242 of FIG. 4 may be used in combination with the other sealing features described herein, to provide additional sealing. Thus, any of the embodiments described above with reference to FIGS. 2 and 3 may optionally include a weld at the respective interface 240A, 240B in addition to the threaded and tongue and groove engagement. In such embodiments, the weld may provide additional sealing and may inhibit the threads from unscrewing during operation. By way of another example, a weld may also optionally be added to respective interfaces of the embodiments described below with reference to FIGS. 5 and 6.

Figure 5:
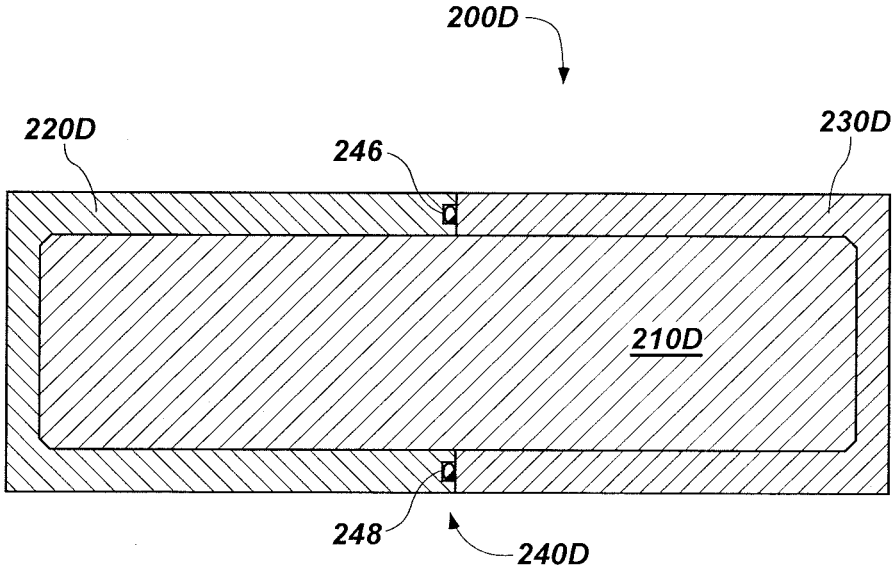
FIG. 5 is an enlarged cross-sectional view of a reinforced shaft according to another embodiment of the present disclosure.

Referring to FIG. 5, another embodiment of a reinforced shaft 200D is shown that includes an inner shaft 210D, a first protective cover portion 220D, and a second protective cover portion 230D. The first and second protective cover portions 220D, 230D may substantially entirely cover (e.g., encapsulate) the inner shaft 210D. The first and second protective cover portions 220D, 230D are also referred to collectively as a protective cover 220D, 230D.

The inner shaft 210D of FIG. 5 may be similar to the inner shaft 210B of FIG. 3 in material composition and in general physical form. The protective cover 220D, 230D of FIG. 5 may be similar to the protective cover 220A, 230A of FIG. 2 in material composition and in outer shape. However, the first and second protective cover portions 220D, 230D may lack threads. Instead, the first and second protective cover portions 220D, 230D may be coupled together and coupled to the inner shaft 210D using an interference fit (e.g., a press fit). By way of example and not limitation, the interference fit may be accomplished by forming the first and second protective cover portions 220D, 230D to have an inner diameter that is slightly smaller than an outer diameter of the inner shaft 210D. The first and second protective cover portions 220D, 230D may be mechanically deformed (e.g., expanded) and positioned around the inner shaft 210D. In some embodiments, positioning the protective cover 220D, 230D around the inner shaft 210D may be facilitated by heating, and therefore expanding, the first and second protective cover portions 220D, 230D and by cooling, and therefore contracting, the inner shaft 210D. The first and second protective cover portions 220D, 230D may then be positioned around the inner shaft 210D, and the protective cover 220D, 230D may contract as it cools while the inner shaft 210D may expand as it is heated until the protective cover 220D, 230D fits snugly around the inner shaft 210D.

An interface 240D between the first protective cover portion 220D and the second protective cover 230D may include one or more sealing features to provide a fluid seal at the interface 240D. For example, as shown in FIG. 5, the first protective cover portions 220D may include an annular recess 246 in which an O-ring 248 may be positioned for sealing against a surface of the second protective cover portion 230D. Of course, the interface 240D may be sealed using other methods, such as one or more of those listed above with reference to FIG. 2, 3, or 4.

Figure 6:
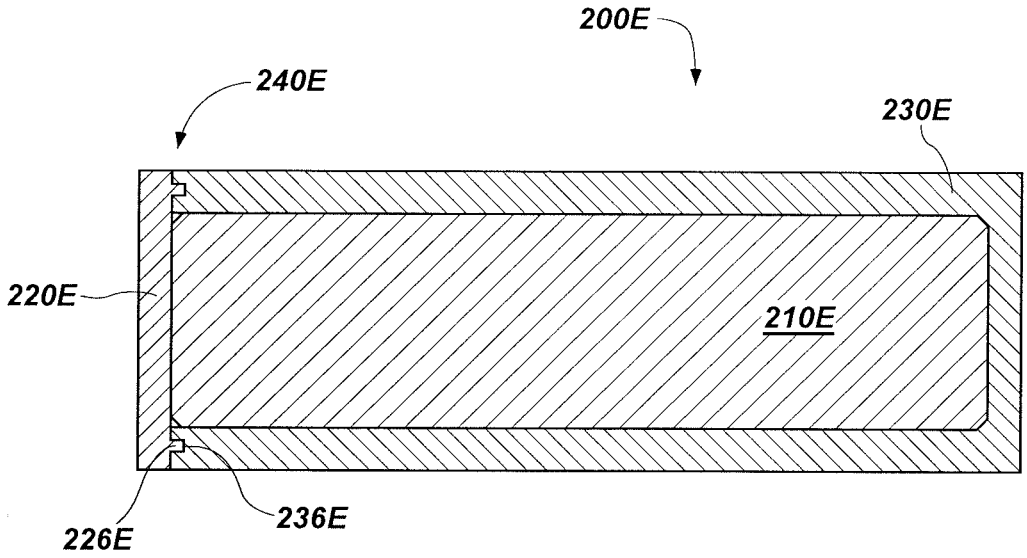
FIG. 6 is an enlarged cross-sectional view of a reinforced shaft according to another embodiment of the present disclosure.

Referring to FIG. 6, another embodiment of a reinforced shaft 200E is shown that includes an inner shaft 210E, a first protective cover portion 220E, and a second protective cover portion 230E. The first and second protective cover portions 220E, 230E may substantially entirely cover (e.g., encapsulate) the inner shaft 210E. The first and second protective cover portions 220E, 230E are also referred to collectively as a protective cover 220E, 230E.

The inner shaft 210E of FIG. 6 may be similar to the inner shaft 210B of FIG. 3 in material composition and in general physical form. The protective cover 220E, 230E of FIG. 6 may be similar to the protective cover 220A, 230A of FIG. 2 in material composition. However, the second protective cover portion 230E may be sized and configured to cover a majority of an outer surface of the inner shaft 210E, and the first protective cover portion 220E may be sized and configured to cover a minor portion of the outer surface of the inner shaft 210E. In some embodiments, the first protective cover portion 220E may be configured as a cap for coupling to the second protective cover portion 230E. As shown in FIG. 6, an interface 240E between the first and second protective cover portions 220E, 230E may include one or more sealing features to provide a fluid seal at the interface 240E. For example, the first protective cover portion 220E may include an annular protrusion 226E and the second protective cover portion 230E may include a complementary annular groove 236E, which may be used to form a tongue and groove joint and to inhibit subject fluid from leaking through the interface 240E. Of course, the interface 240E may be sealed using other methods, such as one or more of those listed above with reference to FIG. 2, 3, 4, or 5. In addition, in other embodiments, the first protective cover portion 220E configured as a cap may be coupled to the second protective cover portion 230E using threads, such as threads similar to those described above with reference to FIG. 3.

Figure 7:
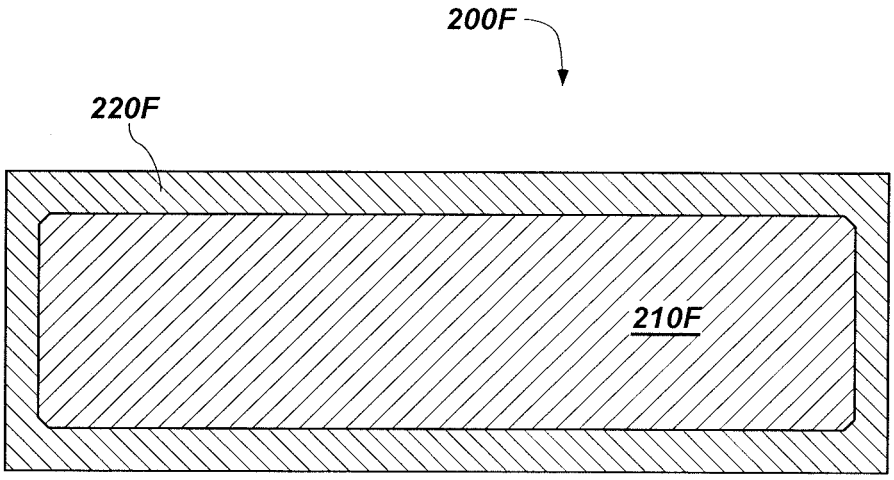
FIG. 7 is an enlarged cross-sectional view of a reinforced shaft according to another embodiment of the present disclosure.

Referring to FIG. 7, another embodiment of a reinforced shaft 200F is shown that includes an inner shaft 210F and a protective cover 220F. The protective cover 220F may substantially entirely cover (e.g., encapsulate) the inner shaft 210F.

The inner shaft 210F of FIG. 7 may be similar to the inner shaft 210B of FIG. 3 in material composition and in general physical form. The protective cover 220F of FIG. 7 may be similar to the protective cover 220A, 230A of FIG. 2 in material composition. However, the protective cover 220F may be a monolithic structure, and, therefore, may not include multiple portions. The protective cover 220F may be formed as a monolithic structure by overmolding the inner shaft 210F with material of the protective cover 220F. By way of example and not limitation, example embodiments of methods and devices that may be used for overmolding the inner shaft 210F with material of the protective cover 220F are disclosed in International Publication No. WO 83/04265, filed Jan. 24, 1983 in the name of Mattel, Inc., and U.S. Pat. No. 6,441,741, issued Aug. 27, 2002 to Yoakum, the disclosure of each of which is incorporated herein in its entirety by this reference. For example, the inner shaft 210F may be positioned within a mold cavity using one or more retractable standoffs or pins. The standoffs or pins may be configured to hold the inner shaft 210F in position within the mold cavity as molten material is initially introduced into the mold cavity to form the protective cover 220F. As the mold cavity is filled with the molten material, pressure within the mold cavity may increase and cause the standoffs or pins to retract away from the inner shaft 210F. The space vacated by the retracting standoffs or pins may be filled with additional molten material. Thus, the inner shaft 210F may be entirely covered (e.g., encapsulated) by a single, monolithic protective cover 220F, and the protective cover 220F may be substantially free of any joint or other void through which subject fluid may leak to reach the inner shaft 210F.

Any of the reinforced shafts 200A through 200F described with reference to FIGS. 2 through 7 may be used as the reinforced shaft 200 of FIG. 1.

Reinforced shafts according to the present disclosure may inhibit mechanical deformation of shafts for reciprocating fluid pumps while still exhibiting resistance to corrosion by and/or contamination of subject fluid to be pumped by the reciprocating fluid pumps. As noted above, inner shafts of the reinforced shafts may be more mechanically stable than protective covers thereof, while the protective covers may be more chemically stable when exposed to the subject fluid than the inner shafts. Among other benefits, the improved mechanical stability of the reinforced shafts may reduce an amount of subject fluid that may communicate between subject fluid chambers through a bore in which the reinforced shafts are disposed. Thus, such reinforced shafts may improve a pumping efficiency of associated pumps over time by reducing damage to the pump due to repeated reciprocating action thereof. In addition, the reinforced shafts of the present disclosure may lengthen an operable life of pumps and reduce maintenance or replacement of pump shafts or even of pumps as a whole. Due to the chemical stability of the protective covers, such mechanical benefits may be realized without compromising chemical benefits of shafts formed of a material that is resistant to corrosion by and/or contamination of subject fluids that the pumps are intended to pump.

Additional non-limiting example embodiments of the present disclosure are set forth below.

Embodiment 1

A pneumatic reciprocating fluid pump for pumping a subject fluid, the pump comprising: a first subject fluid chamber; a first plunger configured and positioned to expand and contract a volume of the first subject fluid chamber; a second subject fluid chamber; a second plunger configured and positioned to expand and contract a volume of the second subject fluid chamber; and a reinforced shaft extending between the first plunger and the second plunger, the reinforced shaft comprising: an inner shaft; and a protective cover at least substantially encapsulating the inner shaft, the inner shaft exhibiting a greater resistance to mechanical deformation than the protective cover and the protective cover exhibiting a greater resistance to chemical corrosion by the subject fluid than the inner shaft.

Embodiment 2

The pump of Embodiment 1, wherein the inner shaft of the reinforced shaft is at least substantially comprised of one or more of polyetheretherketone (PEEK), polyetherketone (PEK), ethylene-tetrafluoroethylene copolymer (ETFE), chlorotrifluoroethylene (CTFE), ethylene-chlorotrifluoroethylene copolymer (ECTFE), polyvinylidene fluoride (PVDF), stainless steel, and a metal alloy having a nickel content higher than about 40% by mass.

Embodiment 3

The pump of Embodiment 2, wherein the inner shaft of the reinforced shaft is at least substantially comprised of one of PEEK and PEK.

Embodiment 4

The pump of any one of Embodiments 1 through 3, wherein the protective cover of the reinforced shaft is at least substantially comprised of one or more of a fluoropolymer, a fluoropolymer elastomer, neoprene, buna-N, ethylene propylene diene monomer M-class (EPDM), polyurethane, a thermoplastic polyester elastomer, a thermoplastic vulcanizate (TPV), fluorinated ethylene-propylene (FEP), a fluorocarbon resin, perfluoroalkoxy (PFA), ethylene-chlorotrifluoroethylene copolymer (ECTFE), ethylene-tetrafluoroethylene copolymer (ETFE), nylon, polyethylene, polyvinylidene fluoride (PVDF), polytetrafluoroethylene (PTFE), chlorotrifluoroethylene (CTFE), nitrile, and another fully or partially fluorinated polymer.

Embodiment 5

The pump of any one of Embodiments 1 through 4, wherein the protective cover of the reinforced shaft is at least substantially comprised of PFA.

Embodiment 6

The pump of any one of Embodiments 1 through 5, wherein the protective cover comprises a first protective cover portion and a second protective cover portion.

Embodiment 7

The pump of Embodiment 6, wherein the first protective cover portion is coupled to the second protective cover portion using at least one of threads, a weld, an adhesive, and a tongue and groove joint.

Embodiment 8

The pump of any one of Embodiments 6 and 7, further comprising a sealing feature for inhibiting the subject fluid from leaking through an interface between the first protective cover portion and the second protective cover portion to the inner shaft.

Embodiment 9

The pump of Embodiment 8, wherein the sealing feature comprises at least one of a tongue and groove joint, an O-ring, a weld, a gasket, and an adhesive.

Embodiment 10

The pump of any of Embodiments 6 through 9, wherein the first protective cover portion is sized and configured for covering a minor portion of the inner shaft and the second protective cover portion is sized and configured for covering a majority of the inner shaft.

Embodiment 11

The pump of any of Embodiments 1 through 10, wherein the inner shaft comprises at least one thread for coupling the protective cover thereto.

Embodiment 12

The pump of any one of Embodiments 6 through 11, wherein each of the first protective cover portion and the second protective cover portion comprises at least two recesses configured to facilitate threading thereof to the inner shaft with a tool complementary to the at least two recesses.

Embodiment 13

The pump of any one of Embodiments 1 through 12, wherein the protective cover is coupled to the inner shaft using at least one of a thread, an adhesive, and an interference fit.

Embodiment 14

The pump of any one of Embodiments 1 through 5, wherein the protective cover is a monolithic structure.

Embodiment 15

The pump of Embodiment 14, wherein the protective cover is formed by overmolding the inner shaft with a molten material.

Embodiment 16

The pump of any one of Embodiments 1 through 15, wherein the first plunger and the second plunger each comprise one of a bellows and a diaphragm.

Embodiment 17

A method of forming a reciprocating fluid pump for pumping a subject fluid, the method comprising: forming a reinforced shaft, comprising: at least substantially encapsulating an inner shaft comprised of a first material with a protective covering comprised of a second material different than the first material; and positioning the reinforced shaft at least partially within one or both of a first subject fluid chamber and a second subject fluid chamber and between a first plunger at least partially defining the first subject fluid chamber and a second plunger at least partially defining the second subject fluid chamber.

Embodiment 18

The method of Embodiment 17, wherein forming the reinforced shaft further comprises selecting the first material of the inner shaft from the group consisting of polyetheretherketone (PEEK), polyetherketone (PEK), ethylene-tetrafluoroethylene copolymer (ETFE), chlorotrifluoroethylene (CTFE), ethylene-chlorotrifluoroethylene copolymer (ECTFE), polyvinylidene fluoride (PVDF), stainless steel, and a metal alloy having a nickel content higher than about 40% by mass.

Embodiment 19

The method of any one of Embodiments 17 and 18, wherein selecting the first material of the inner shaft comprises selecting the first material from the group consisting of PEEK and PEK.

Embodiment 20

The method of any one of Embodiments 17 through 19, wherein forming the reinforced shaft further comprises selecting the second material of the protective covering from the group consisting of a fluoropolymer, a fluoropolymer elastomer, neoprene, buna-N, ethylene propylene diene monomer M-class (EPDM), polyurethane, a thermoplastic polyester elastomer, a thermoplastic vulcanizate (TPV), fluorinated ethylene-propylene (FEP), a fluorocarbon resin, perfluoroalkoxy (PFA), ethylene-chlorotrifluoroethylene copolymer (ECTFE), ethylene-tetrafluoroethylene copolymer (ETFE), nylon, polyethylene, polyvinylidene fluoride (PVDF), polytetrafluoroethylene (PTFE), chlorotrifluoroethylene (CTFE), nitrile, and another fully or partially fluorinated polymer.

Embodiment 21

The method of any one of Embodiments 17 through 20, wherein selecting the second material of the protective covering comprises selecting PFA for the second material of the protective covering.

Embodiment 22

The method of any one of Embodiments 17 through 21, wherein forming the reinforced shaft further comprises coupling a first protective cover portion and a second protective cover portion to the inner shaft.

Embodiment 23

The method of Embodiment 22, further comprising sealing an interface between the first protective cover portion and the second protective cover portion to inhibit leaking of subject fluid through the interface.

Embodiment 24

A reinforced shaft for a reciprocating fluid pump for pumping a subject fluid, the reinforced shaft comprising: an inner shaft exhibiting a first mechanical stability and a first chemical stability when exposed to the subject fluid; and a protective covering exhibiting a second mechanical stability less than the first mechanical stability and a second chemical stability when exposed to the subject fluid greater than the first chemical stability when exposed to the subject fluid.

Embodiment 25

The reinforced shaft of Embodiment 24, wherein the inner shaft consists of one or more of polyetheretherketone (PEEK), polyetherketone (PEK), ethylene-tetrafluoroethylene copolymer (ETFE), chlorotrifluoroethylene (CTFE), ethylene-chlorotrifluoroethylene copolymer (ECTFE), polyvinylidene fluoride (PVDF), stainless steel, and a metal alloy having a nickel content higher than about 40% by mass.

Embodiment 26

The reinforced shaft of Embodiment 24, wherein the protective cover of the reinforced shaft is at least substantially comprised of one or more of a fluoropolymer, a fluoropolymer elastomer, neoprene, buna-N, ethylene propylene diene monomer M-class (EPDM), polyurethane, a thermoplastic polyester elastomer, a thermoplastic vulcanizate (TPV), fluorinated ethylene-propylene (FEP), a fluorocarbon resin, perfluoroalkoxy (PFA), ethylene-chlorotrifluoroethylene copolymer (ECTFE), ethylene-tetrafluoroethylene copolymer (ETFE), nylon, polyethylene, polyvinylidene fluoride (PVDF), polytetrafluoroethylene (PTFE), chlorotrifluoroethylene (CTFE), nitrile, and another fully or partially fluorinated polymer.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A pneumatic reciprocating fluid pump for pumping a subject fluid, the pump comprising:

a first subject fluid chamber;

a first plunger configured and positioned to expand and contract a volume of the first subject fluid chamber;

a second subject fluid chamber;

a second plunger configured and positioned to expand and contract a volume of the second subject fluid chamber; and a reinforced shaft extending between the first plunger and the second plunger, the reinforced shaft comprising:

an inner shaft comprising exterior surfaces; and a protective cover comprising inner surfaces, the protective cover entirely encapsulating the inner shaft, the inner shaft exhibiting a greater resistance to mechanical deformation than the protective cover and the protective cover exhibiting a greater resistance to chemical corrosion by the subject fluid than the inner shaft, wherein substantially all of the inner surfaces of the protective cover abut the exterior surfaces of the inner shaft.

2. The pump of claim 1, wherein the inner shaft of the reinforced shaft is at least substantially comprised of one or more of polyetheretherketone (PEEK), polyetherketone (PEK), ethylene-tetrafluoroethylene copolymer (ETFE), chlorotrifluoroethylene (CTFE), ethylene-chlorotrifluoroethylene copolymer (ECTFE), polyvinylidene fluoride (PVDF), stainless steel, and a metal alloy having a nickel content higher than about 40% by mass.

3. The pump of claim 2, wherein the inner shaft of the reinforced shaft is at least substantially comprised of one of PEEK and PEK.

4. The pump of claim 2, wherein the protective cover of the reinforced shaft is at least substantially comprised of one or more of a fluoropolymer, a fluoropolymer elastomer, neoprene, buna-N, ethylene propylene diene monomer M-class (EPDM), polyurethane, a thermoplastic polyester elastomer, a thermoplastic vulcanizate (TPV), fluorinated ethylene-propylene (FEP), a fluorocarbon resin, perfluoroalkoxy (PFA), ethylene-chlorotrifluoroethylene copolymer (ECTFE), ethylene-tetrafluoroethylene copolymer (ETFE), nylon, polyethylene, polyvinylidene fluoride (PVDF), polytetrafluoroethylene (PTFE), chlorotrifluoroethylene (CTFE), nitrile, and another fully or partially fluorinated polymer.

5. The pump of claim 4, wherein the protective cover of the reinforced shaft is at least substantially comprised of PFA.

6. The pump of claim 1, wherein the protective cover comprises a first protective cover portion and a second protective cover portion.

7. The pump of claim 6, wherein the first protective cover portion is coupled to the second protective cover portion using at least one of threads, a weld, an adhesive, and a tongue and groove joint.

8. The pump of claim 6, further comprising a sealing feature for inhibiting the subject fluid from leaking through an interface between the first protective cover portion and the second protective cover portion to the inner shaft.

9. The pump of claim 8, wherein the sealing feature comprises at least one of a tongue and groove joint, an O-ring, a weld, a gasket, and an adhesive.

10. The pump of claim 6, wherein the first protective cover portion is sized and configured for covering a minor portion of the inner shaft and the second protective cover portion is sized and configured for covering a majority of the inner shaft.

11. The pump of claim 6, wherein the inner shaft comprises at least one thread for coupling the protective cover thereto.

12. The pump of claim 11, wherein each of the first protective cover portion and the second protective cover portion comprises at least two recesses configured to facilitate threading thereof to the inner shaft with a tool complementary to the at least two recesses.

13. The pump of claim 1, wherein the protective cover is coupled to the inner shaft using at least one of a thread, an adhesive, and an interference fit.

14. The pump of claim 1, wherein the protective cover is a monolithic structure.

15. The pump of claim 14, wherein the protective cover is formed by overmolding the inner shaft with a molten material.

16. The pump of claim 1, wherein the first plunger and the second plunger each comprise one of a bellows and a diaphragm.

17. A method of forming a reciprocating fluid pump for pumping a subject fluid, the method comprising:

forming a reinforced shaft, comprising:

entirely encapsulating an inner shaft comprised of a first material with a protective covering comprised of a second material different than the first material; and positioning the reinforced shaft, including the inner shaft and the protective covering, at least partially within one or both of a first subject fluid chamber and a second subject fluid chamber and between a first plunger at least partially defining the first subject fluid chamber and a second plunger at least partially defining the second subject fluid chamber.

18. The method of claim 17, wherein forming the reinforced shaft further comprises selecting the first material of the inner shaft from the group consisting of polyetheretherketone (PEEK), polyetherketone (PEK), ethylene-tetrafluoroethylene copolymer (ETFE), chlorotrifluoroethylene (CTFE), ethylene-chlorotrifluoroethylene copolymer (ECTFE), polyvinylidene fluoride (PVDF), stainless steel, and a metal alloy having a nickel content higher than about 40% by mass.

19. The method of claim 18, wherein selecting the first material of the inner shaft comprises selecting the first material from the group consisting of PEEK and PEK.

20. The method of claim 17, wherein forming the reinforced shaft further comprises selecting the second material of the protective covering from the group consisting of a fluoropolymer, a fluoropolymer elastomer, neoprene, buna-N, ethylene propylene diene monomer M-class (EPDM), polyurethane, a thermoplastic polyester elastomer, a thermoplastic vulcanizate (TPV), fluorinated ethylene-propylene (FEP), a fluorocarbon resin, perfluoroalkoxy (PFA), ethylene-chlorotrifluoroethylene copolymer (ECTFE), ethylene-tetrafluoroethylene copolymer (ETFE), nylon, polyethylene, polyvinylidene fluoride (PVDF), polytetrafluoroethylene (PTFE), chlorotrifluoroethylene (CTFE), nitrile, and another fully or partially fluorinated polymer.

21. The method of claim 20, wherein selecting the second material of the protective covering comprises selecting PFA for the second material of the protective covering.

22. The method of claim 17, wherein at least entirely encapsulating the inner shaft comprised of the first material with the protective covering comprises coupling a first protective cover portion and a second protective cover portion to the inner shaft.

23. The method of claim 22, further comprising sealing an interface between the first protective cover portion and the second protective cover portion to inhibit leaking of subject fluid through the interface.

24. A reciprocating fluid pump for pumping a subject fluid, comprising:

a reinforced shaft, comprising:

an inner shaft exhibiting a first mechanical stability and a first chemical stability when exposed to the subject fluid; and a protective covering exhibiting a second mechanical stability less than the first mechanical stability and a second chemical stability when exposed to the subject fluid greater than the first chemical stability when exposed to the subject fluid, the protective covering entirely encapsulating the inner shaft, wherein the reinforced shaft, including the inner shaft and the protective covering, is positioned at least partially within at least one of a first subject fluid chamber and a second subject fluid chamber of the reciprocating fluid pump.

25. The reciprocating fluid pump of claim 24, wherein the inner shaft consists of one or more of polyetheretherketone (PEEK), polyetherketone (PEK), ethylene-tetrafluoroethylene copolymer (ETFE), chlorotrifluoroethylene (CTFE), ethylene-chlorotrifluoroethylene copolymer (ECTFE), polyvinylidene fluoride (PVDF), stainless steel, and a metal alloy having a nickel content higher than about 40% by mass.

26. The reciprocating fluid pump of claim 24, wherein the protective cover of the reinforced shaft is at least substantially comprised of one or more of a fluoropolymer, a fluoropolymer elastomer, neoprene, buna-N, ethylene propylene diene monomer M-class (EPDM), polyurethane, a thermoplastic polyester elastomer, a thermoplastic vulcanizate (TPV), fluorinated ethylene-propylene (FEP), a fluorocarbon resin, perfluoroalkoxy (PFA), ethylene-chlorotrifluoroethylene copolymer (ECTFE), ethylene-tetrafluoroethylene copolymer (ETFE), nylon, polyethylene, polyvinylidene fluoride (PVDF), polytetrafluoroethylene (PTFE), chlorotrifluoroethylene (CTFE), nitrile, and another fully or partially fluorinated polymer.

* * * * *